US007348954B2

(12) United States Patent
Miwa et al.

(10) Patent No.: US 7,348,954 B2
(45) Date of Patent: Mar. 25, 2008

(54) LIQUID CRYSTAL DISPLAY

(75) Inventors: Hirokazu Miwa, Kawasaki (JP); Hiromi Enomoto, Kawasaki (JP); Hongyong Zhang, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/023,344

(22) Filed: Dec. 17, 2001

(65) Prior Publication Data

US 2002/0080106 A1 Jun. 27, 2002

(30) Foreign Application Priority Data

Dec. 27, 2000 (JP) ..... 2000-398892

(51) Int. Cl.
*G09G 3/36* (2006.01)

(52) U.S. Cl. ..... 345/98; 345/89; 345/100; 345/204

(58) Field of Classification Search ..... 345/87–104, 345/204–206, 208–210, 690; 349/139, 137
See application file for complete search history.

(56) References Cited

U.S. PATENT DOCUMENTS

| | | | | |
|---|---|---|---|---|
| 5,028,916 | A * | 7/1991 | Ichikawa et al. | 345/90 |
| 5,034,736 | A * | 7/1991 | Bennett et al. | 345/100 |
| 5,061,920 | A * | 10/1991 | Nelson | 345/89 |
| 5,657,040 | A * | 8/1997 | Kanbara | 345/98 |
| 5,686,936 | A * | 11/1997 | Maekawa et al. | 345/100 |
| 5,801,672 | A * | 9/1998 | Masuda et al. | 345/98 |
| 6,023,260 | A * | 2/2000 | Higashi | 345/100 |
| 6,072,456 | A * | 6/2000 | Karube et al. | 345/98 |
| 6,091,392 | A * | 7/2000 | Imamura | 345/100 |
| 6,246,385 | B1 * | 6/2001 | Kinoshita et al. | 345/87 |
| 6,265,889 | B1 * | 7/2001 | Tomita et al. | 324/765 |
| 6,377,235 | B1 * | 4/2002 | Murade et al. | 345/100 |
| 6,392,628 | B1 * | 5/2002 | Yamazaki et al. | 345/98 |
| 6,507,332 | B1 * | 1/2003 | Kuwabara et al. | 345/103 |
| 6,531,996 | B1 * | 3/2003 | Murade | 345/98 |
| 6,611,261 | B1 * | 8/2003 | Zhang et al. | 345/204 |
| 6,847,344 | B2 * | 1/2005 | Ha | 345/95 |
| 2002/0003521 | A1 * | 1/2002 | Matsueda et al. | 345/89 |
| 2002/0030648 | A1 * | 3/2002 | Yamamoto et al. | 345/87 |

FOREIGN PATENT DOCUMENTS

| | | |
|---|---|---|
| JP | 63-304229 | 12/1988 |
| JP | 11-167094 | 6/1999 |
| JP | 11-338432 | 12/1999 |
| JP | 11-448432 | 12/1999 |
| JP | 2000-75842 | 3/2000 |

* cited by examiner

*Primary Examiner*—Lun-Yi Lao
(74) *Attorney, Agent, or Firm*—Greer, Burns & Crain, Ltd.

(57) ABSTRACT

A liquid crystal display includes a display part displaying an image in accordance with image display data supplied through data signal lines, and a driving part driving the data signal lines by using a plurality of driving devices simultaneously for each data signal line.

2 Claims, 22 Drawing Sheets

LIQUID CRYSTAL DISPLAY

BACKGROUND OF THE INVENTION

1. Field of the Invention

The present invention relates to a liquid crystal display.

2. Description of the Related Art

An active-matrix-type liquid crystal display such as a TFT (Thin Film Transistor) liquid crystal panel is expected to be widely used as a display of a television for home use or an OA apparatus. This is because, according to the active-matrix-type liquid crystal display, it is possible to easily obtain thin and light-weight display device, and, also, to provide image display which has a quality not lower than that of a conventional CRT display.

Furthermore, as this type of display device is thin and of a light weight, it is expected to employ it not only for a portable information apparatus such as a notebook-type personal computer, but also other various multimedia information apparatus. For this purpose, development for a liquid crystal display employing a block sequential driving scheme, by which it is possible to obtain a thin and light-weight liquid crystal display of an effectively reduced frame size, a high definition, and, also, a large-sized screen, has been proceeded.

A panel structure of the active-matrix-type liquid crystal display, which is a type of a flat-panel display, and can provide a high-quality image display, will now be described. The active-matrix-type liquid crystal display has a panel structure such that, as shown in FIG. 1, liquid crystal is sealed between a TFT substrate which has pixel electrodes 110 disposed in a matrix manner and switching devices (TFT, etc.) 112 prepared for the respective pixel electrodes 110, and a common substrate on which common electrodes are formed throughout the surface thereof.

Data signal lines DL and scanning lines (scanning electrodes) 114 intersect by a matrix manner on the TFT substrate, and a TFT is connected to each of all the intersections as the switching device 112. The TFTs on the line selected by the scanning line 114 are turned on, an image signal voltage applied to the data signal line DL is applied to each pixel electrode 110, and the information is held until the line is selected subsequently, as a result of the electric charge being held there.

Since inclination of the liquid crystal molecule is determined according to the thus-held information, the amount of light transmission by the liquid crystal display panel can be controlled thereby, and, thus, expression of various gray scales can be attained there. Furthermore, for a color display, mixture of light is performed by using an RGB color filter. as well-known.

FIGS. 2A and 2B illustrate configurations of liquid crystal displays in the related art. In the liquid crystal display shown in FIG. 2A, a scanning line driver 1, a top data signal line driver 3 and a bottom data signal line driver 5 to each of which data for display is supplied, are arranged around a display area 100. In the liquid crystal display shown in FIG. 2B, a data signal line driver 7 is provided only on one side of the display area 100.

Thus, for general liquid crystal displays in the related art, respective driver ICs for data signal lines and scanning lines are arranged around the panel and mounted by TAB press-fixing way or a COG (Chip On Glass) mounting way, and, thereby, each bus line is driven, and, thus, image display is performed through the display area 100.

Recently, development of liquid crystal displays of polysilicon LCD type in which a driving circuit is formed directly on a glass substrate (TFT substrate of the liquid crystal panel) by using polysilicon material. According to the liquid crystal display of this polysilicon LCD type, a driving circuit is formed on the glass substrate, and, thereby, a so-called frame space provided around the display screen or the like can be effectively eliminated. Further, since the circuit structure is also formed during a TFT substrate manufacturing process, a separate process of assembling IC after that can be eliminated. Thereby, the polysilicon LCD type liquid crystal display is further demanded to have a larger-sized screen and a higher display definition.

For such a driving circuit of the liquid crystal panel of the above-mentioned polysilicon LCD type, study has been proceeded for a scheme in which display data is sent to respective blocks of the display area through data signal lines sequentially (block sequential driving scheme), and thus, the panel is driven for respective divisions thereof sequentially.

FIG. 3 shows a configuration of a liquid crystal display employing the above-mentioned block sequential driving scheme in the related art. This liquid crystal display includes a display area 100, a driver IC 9, a shift register 11, a multiplexer 13, a buffer 15, and video lines VL and analog switches AS. In this configuration, the number of pixels of the display area 100 is set as (800×RGB×600), also, it is divided into blocks BL1 through BL8. To the driver IC 9, eight block selection pulses SBL1 through SBL8, display signals D1 through D300, and a gate control signal GC are input.

Further, the analog switches AS are turned on according to the block selection pulses, and therethrough, the display signals are supplied to the corresponding blocks via the video lines VL and the data signal lines DL.

In this configuration, as the circuit formed on a glass substrate is merely a selector part in which the analog switches AS are disposed side by side, it is possible to effectively simplify the circuit included in the liquid crystal display, and, thus, it is possible to improve the yield of the liquid crystal panels.

Furthermore, since a conventional general-purpose data driver can be utilized there, it becomes possible to produce the polysilicon LCD at a low cost. Further, development for realization of a high-display-definition polysilicon LCD having a large-sized screen has been further proceeded by increase in the number of divided blocks, employing a multi-output IC of a general-purpose data driver, etc.

However, in case a general-purpose driver is used there, improvement in the driving capability of the driver is demanded. Namely, in the conventional driver, the required charging-up time for the data bus and video lines for the respective blocks may not match the timing of driving for the respective divided blocks. In such a situation, switching of data may not be performed smoothly, and, may result in problematic image display.

In the liquid crystal panel formed through an amorphous silicon process, only pixel cells arranged in a matrix manner in the display area, switching devices, data signal lines, and scanning lines are provided. The pixel cells include pixel electrodes 110, common electrodes opposite thereto, and liquid crystal layers provided therebetween.

Further, the data driver which performs display drive of this panel has an analog or multi-bit digital gray scale signal input thereto from a personal computer, etc., and, in case of the digital gray scale signal, a multi-gray scale is displayed by converting it into an analog gray scale voltage of the 64 gray scales or the 256 gray scales which is then provided to the liquid crystal panel.

In the liquid crystal panel (may be simply referred to as a "panel") formed using polysilicon, all or part of the driving circuit may be formed on the panel glass together with the display area, as a peripheral circuit of the display area. Then, this driving circuit may be used as the scanning line driver. Also, part of the driving circuit may be used as the data signal line driver, is formed on the panel glass, and this data signal line peripheral circuit is controlled by a control circuit outside of the panel. Thereby, the above-mentioned block sequential driving scheme can be realized.

However, in case of the peripheral circuit provided on the panel formed using polysilicon, by a reason concerning the characteristic of transistors included in the peripheral circuit, not an IC logic level such as 3.3 V but a higher voltage such as 10 V or higher, for example, is needed for driving the peripheral circuit. Therefore, level conversion is needed between the logic level of the control signal used in the outside of the panel and the operation voltage of the peripheral circuit formed on the panel.

SUMMARY OF THE INVENTION

The present invention has been devised in order to solve the above-described problems, and, an object of the present invention is to provide a liquid crystal display by which a satisfactory display image can be obtained with a relatively simple configuration.

A liquid crystal display according to the present invention includes:

a display part displaying an image in accordance with image display data supplied through data signal lines; and a driving part driving the data signal lines by using a plurality of driving devices simultaneously for each data signal line.

Thereby, it is possible to effectively increase the driving capability for the data signal lines, and, thus, it is possible to effectively reduce time required for charging up the data signal lines. As a result, the signal levels applied to the pixel electrodes of the liquid crystal display part can be changed rapidly enough so that the liquid crystals can react smoothly so as to attain satisfactory image display therethrough.

The plurality of driving devices may be disposed on the same side of the data signal lines.

The number of the driving devices used for driving each data signal line may be controlled in accordance with a particular type of the display part. Thereby, it is possible to easily optimize the driving capability for the data signal lines according to the particular type of the display part.

The liquid crystal display may further include a wiring part provided on a substrate on which the display part is formed, the driving devices being connected to the signal data lines in the wiring part.

A liquid crystal display according to another aspect of the present invention includes:

a display part displaying an image in accordance with image display data supplied through data signal lines; and a driving part driving the data signal lines by supplying a plurality of same image display data to each data signal line.

Thereby, it is possible to increase the driving capability for the data signal lines.

The driving part supplies, to each data signal line, corresponding image display data.

A liquid crystal display according to another aspect of the present invention includes:

a peripheral circuit supplying image display data to a display part according to a given first control signal;

a driving part supplying the first control signal and the image display data to the peripheral circuit;

a level converting part built in the driving part, and performing level conversion of a given second control signal so as to generate the first control signal.

Thereby, it is possible to easily generate the first control having the signal level suitable for operation of the peripheral circuit through level conversion by a simple configuration.

The display part and peripheral circuit may be formed integrally on a same substrate. In this case, the level conversion should be made in accordance with the characteristics of the substrate.

The liquid crystal display may further include a dividing control signal generating part built in the driving part, and generating the second control signal performing control of the display part in a dividing manner in accordance with a signal supplied from the outside of the driving part.

Thereby, it is possible to drive the display part in the dividing manner (by which the display part is divided into blocks which are then driven sequentially in accordance with the second signal).

The liquid crystal display may further include a selecting part built in the driving part and supplying the second control signal generated by the dividing control signal generating part selectively to the level converting part.

Thereby, it is possible to enable selectively setting of the number of dividing the display part in accordance with the resolution of the display part.

The level converting part may generate the first control signal in accordance with a voltage supplied to the driving part.

Thereby, no special power supply is needed for the level converting part.

The level converting part may generate the first control signal in accordance with a voltage supplied from the outside of the liquid crystal display.

Thereby, it is possible to easily adjust the signal level of the first control signal by changing the voltage supplied form the outside.

BRIEF DESCRIPTION OF THE DRAWINGS

Other objects and further features of the present invention will become more apparent from the following detailed description when read in conjunction with the following accompanying drawings.

DETAILED DESCRIPTION OF THE PREFERRED EMBODIMENTS

Figure 1:
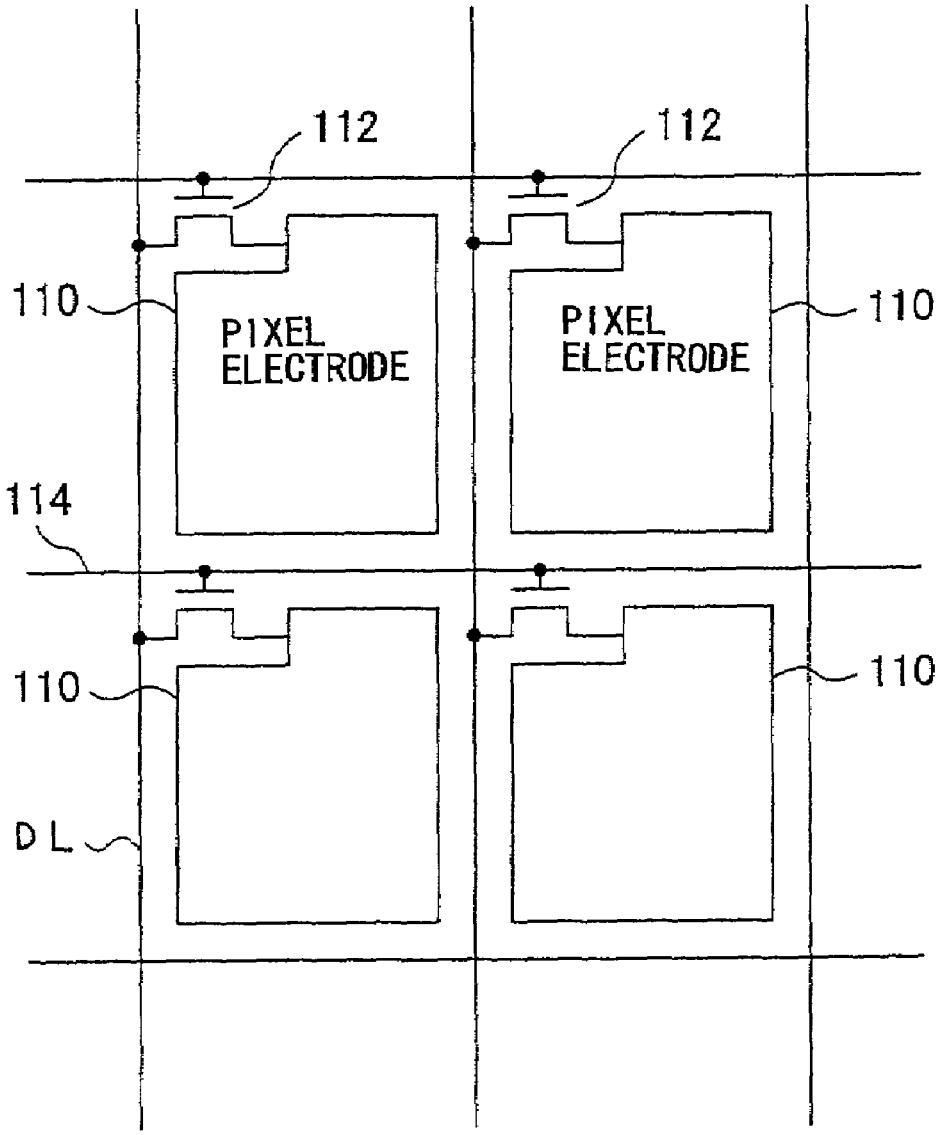
FIG. 1 shows a panel structure of an active-matrix-type liquid crystal display in the related art.
Figure 2A:
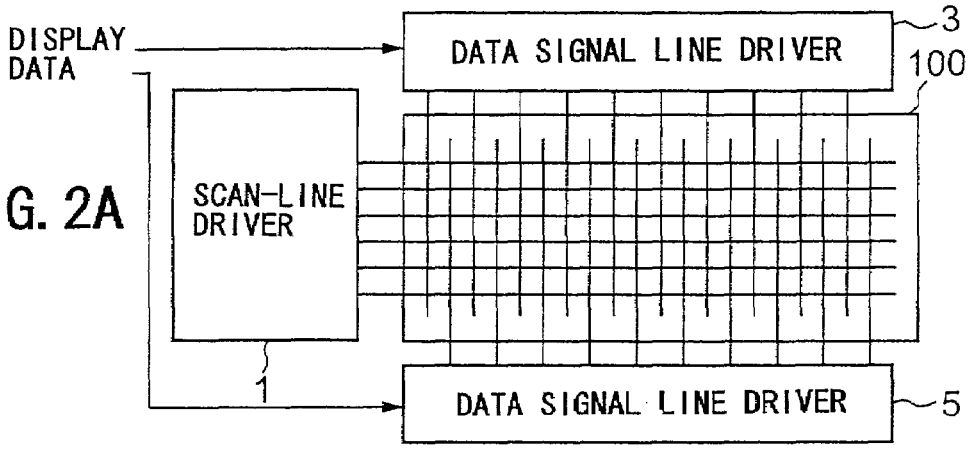
FIGS. 2A and 2B illustrate configurations of liquid crystal displays in the related art.
Figure 2B:
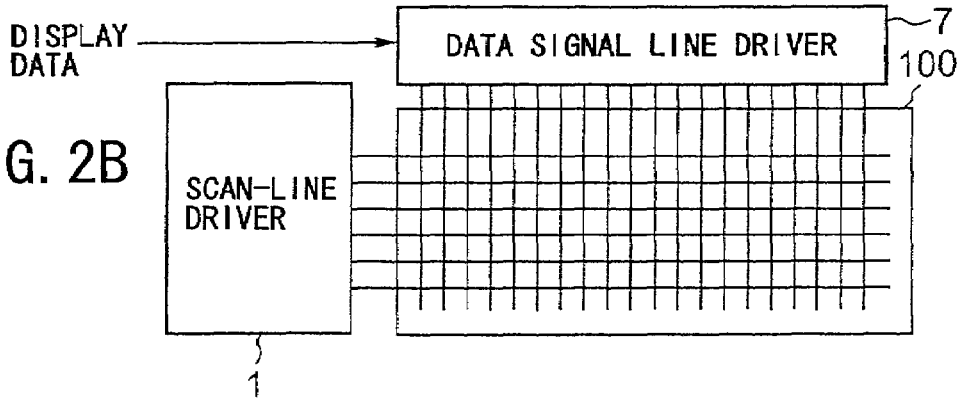

Preferable embodiments of the present invention will now be described with reference to the drawings. The same reference numerals are given to the same or corresponding parts/components.

According to the embodiments of the present invention, in an output part included in a driving circuit of a liquid crystal panel, one output line is driven by a plurality of output buffers, and switching of data signals output from a data driver on video lines and data signal lines is made smoother.

Then, by thus improving the driving capability/performance, the charging-up times required for charging the video lines and data signal lines are made shorter, and, thereby, the charging up operation can be made properly even during switching of display data every block. Thereby, it is possible to provide a driving circuit suitable for the above-described block-sequential-driving-type polysilicon LCD, and, thus, satisfactory image display can be provided.

Namely, according to the embodiments of the present invention, the driving circuit of polysilicon LCD for performing image display using a general-purpose data driver is employed, and, especially, the above-mentioned block sequential driving scheme is effectively applicable. According to the block sequential driving scheme, as described above, data output from the data driver is made correspond to respective divided blocks of the liquid crystal panel, and, data is sequentially provided to the data signal lines corresponding to the respective blocks, and is held there.

The charging up time of data for each block should be within (1 horizontal period)/(number of divided blocks). However, according to general-purpose data driver in the related art, it may not be possible to complete charging up within such a short period.

Therefore, according to the embodiments of the present invention, a plurality of output lines of the general-purpose data driver are connected to a single video line or a single data signal line, and, thereby, data is output through the plurality of output buffers thereto.

Furthermore, by previously providing a plurality of output buffer circuits in an output circuit of the driver used, and, appropriately switching/selecting from these output buffer circuits according to the type of the liquid crystal panel, it is possible that the driving circuit performs charging up by means of the optimum driving capability for the liquid crystal panel.

By thus employing the plurality of buffers for each signal line, it is possible to greatly shorten the charting-up time in comparison to a case where only a single buffer is used for outputting data. Furthermore, by attaining such a greatly reduced charging up time, every liquid-crystal-panel block can be written in satisfactorily, and, thus, the quality of liquid crystal image displaying can be made satisfactory, and also, a satisfactory liquid crystal image displaying can be obtained even at a high definition liquid crystal panel having a large-sized screen.

A first embodiment of the present invention will now be described.

Figure 3:
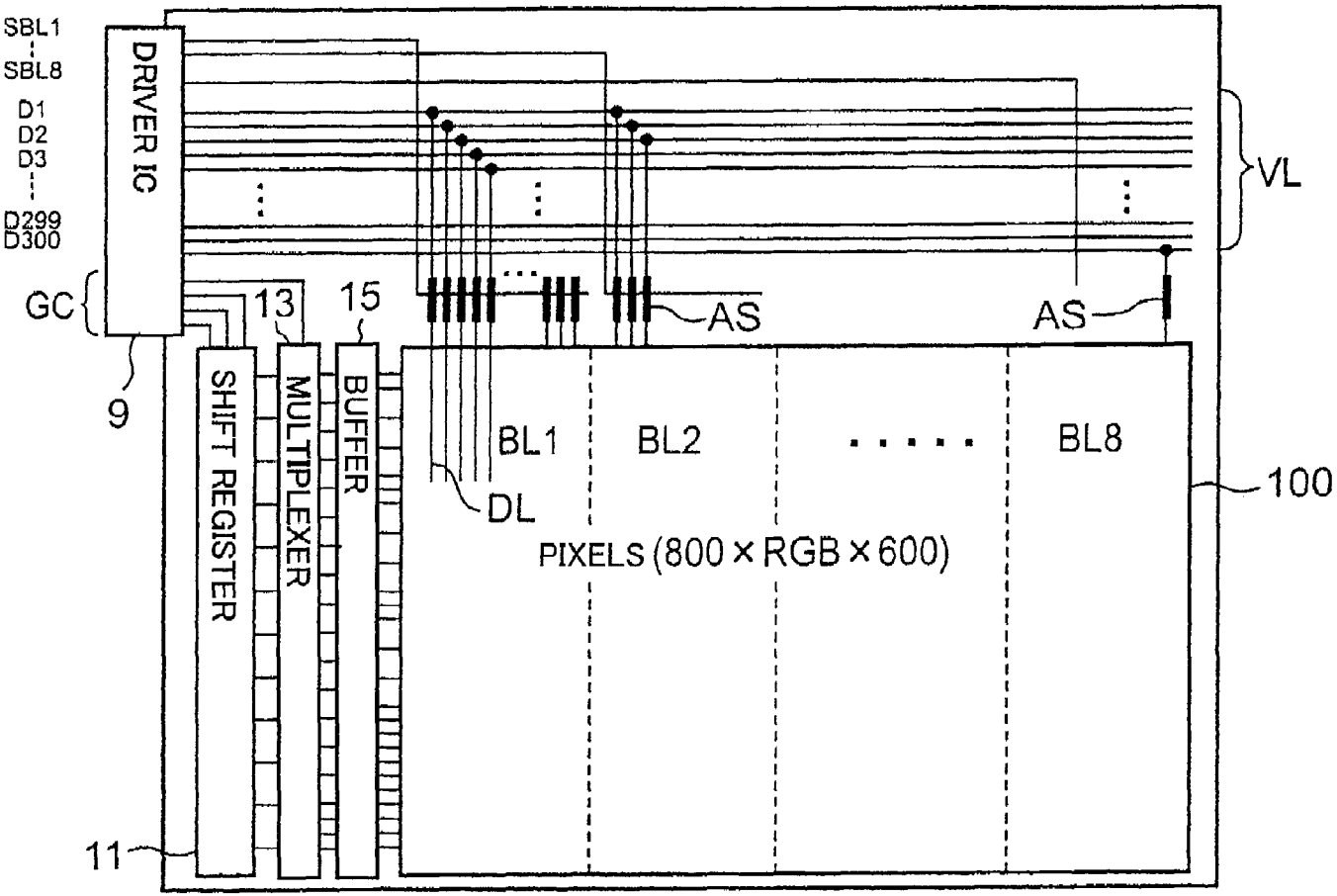
FIG. 3 shows a configuration of a liquid crystal display in the related art employing a block sequential driving scheme.
Figure 4:
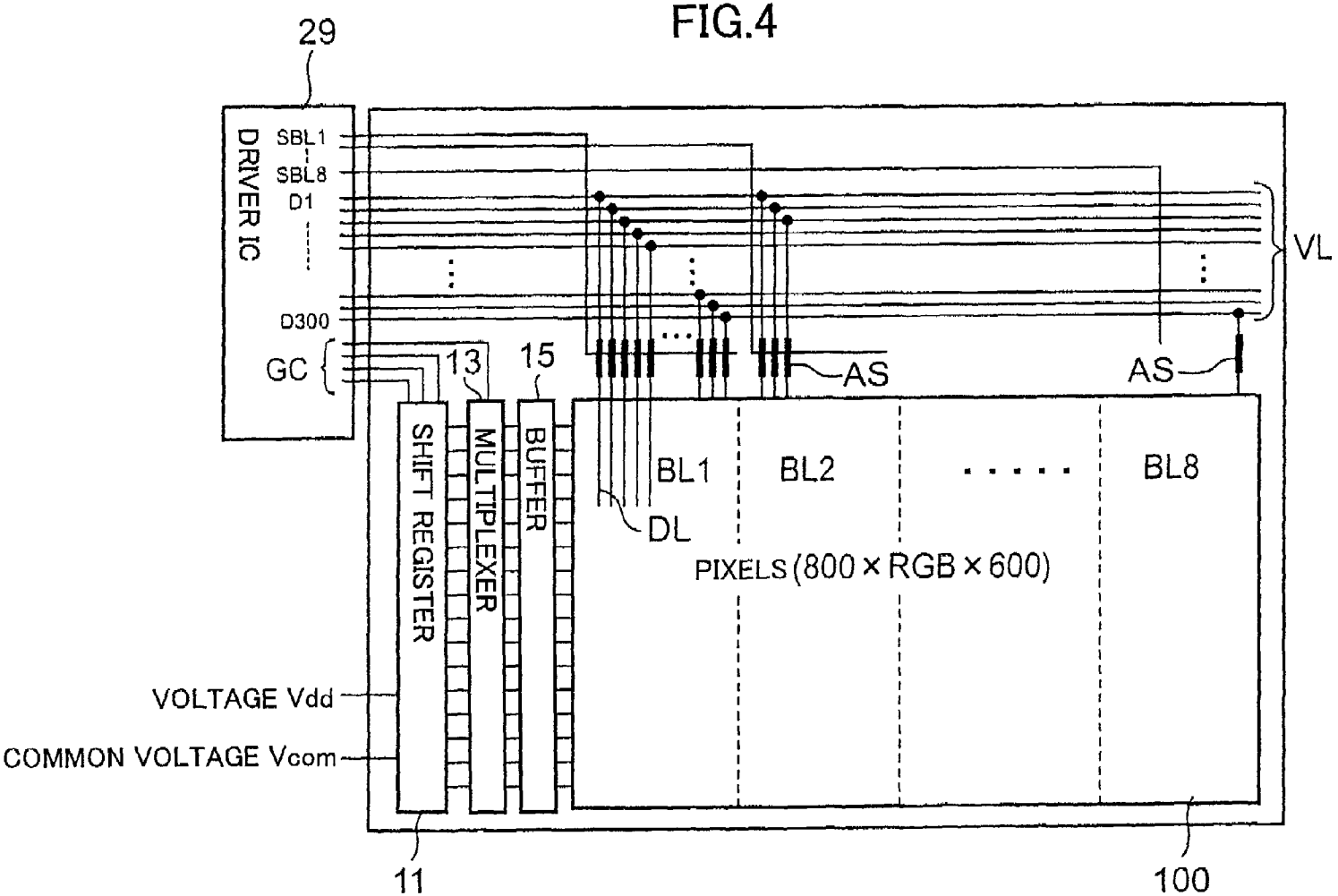
FIG. 4 shows a configuration of a liquid crystal display in a first embodiment of the present invention.

FIG. 4 shows a configuration of a liquid crystal display in the first embodiment of the present invention. This liquid crystal display has the same configuration as that of the liquid crystal display shown in FIG. 3 as long as shown in the figure. However, the configuration of a driver IC 29 differs.

Figure 5:
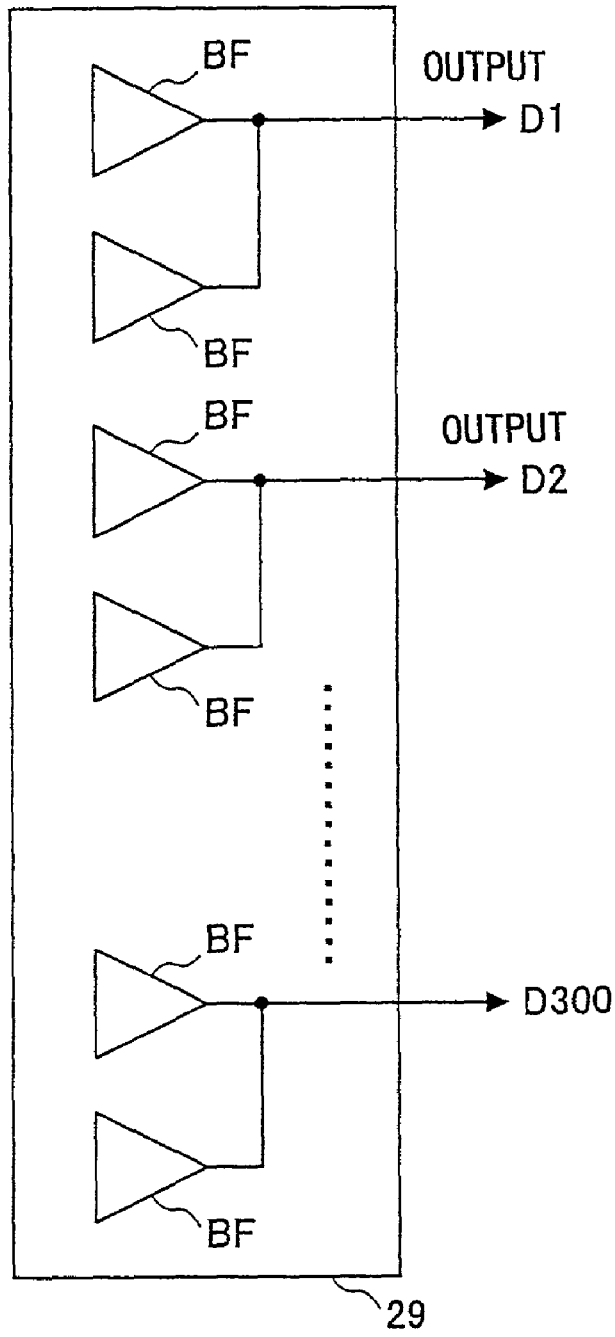
FIG. 5 shows a configuration of a driver IC shown in FIG. 4.

Specifically, in order to drive with respective display signals D1 through D300, as shown in FIG. 5, an output circuit part of the driver IC 29 includes a plurality of output buffers BF for each signal. Further, every two buffers BF are connected to one data signal line DL via a video line VL, and, are disposed on the same side with respect to the relevant data signal line DL.

Thus, the number of buffers used thus increases. However, as the block sequential driving scheme is employed in that respective equally divided parts of the display area 100 are sequentially driven, and thus, data is held there, the number of driver ICs required are inherently reduced.

Figure 6:
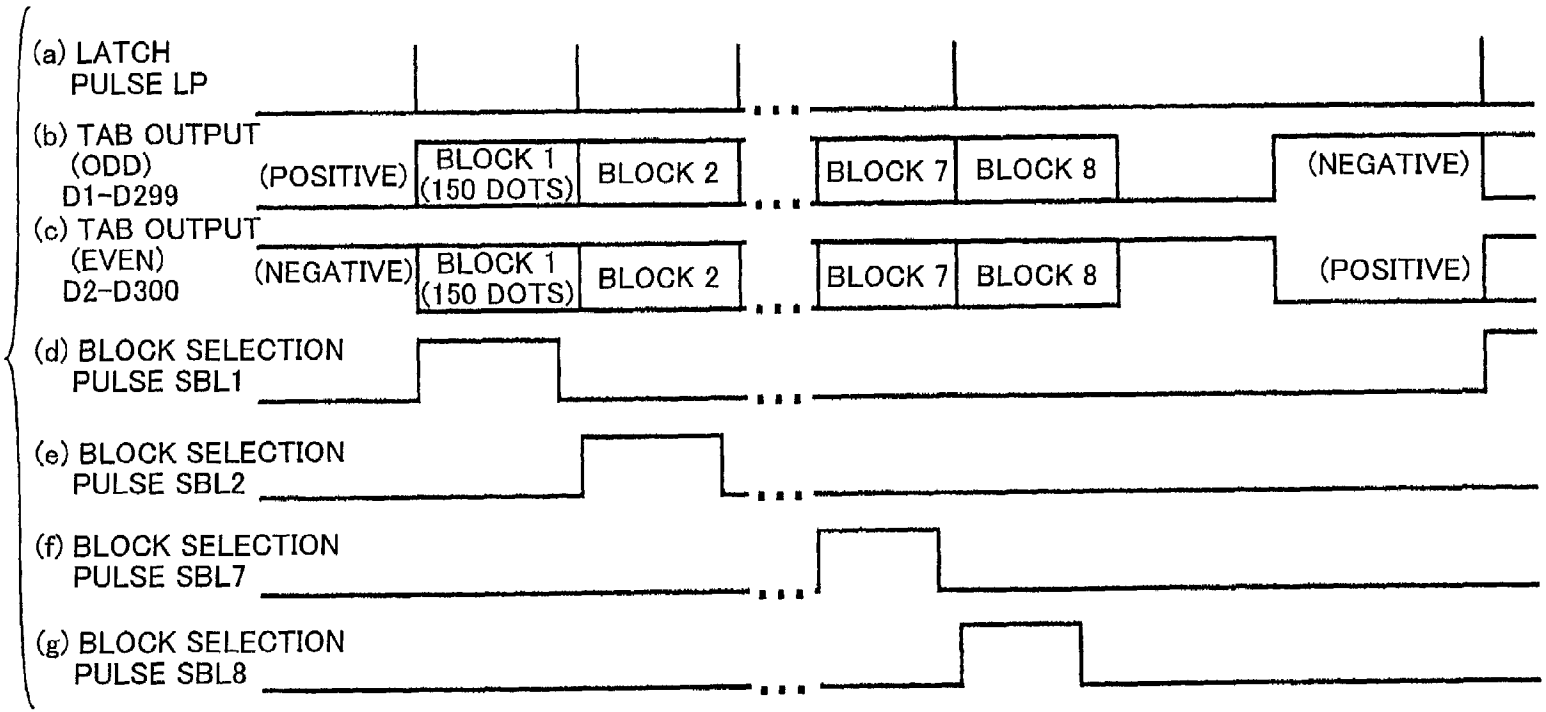
FIG. 6 shows timing charts illustrating operation of the liquid crystal display shown in FIG. 4.

With reference to FIG. 6 showing operation time chart, operation of the liquid crystal display in the first will now be described. First, the timing by which the display signals D1 through D300 are output to the video lines VL from the driver IC 29 is controlled by latch pulses LP shown in FIG. 6, (*a*). As shown in FIG. 6, (*b*) and FIG. 6, (*c*), display signals supplied to blocks BL1 through BL8 of the display area 100 are output to the video lines VL sequentially. Thus, the waveform of TAB output shown in FIG. 6, (*b*) and FIG. 6, (*c*) same as the waveform of signals are transmitted by the video lines VL.

Then, as shown in FIG. 6, (*d*) through (*g*), writing of the data to the data signal lines provided for each block from the video lines VL is performed as a result of block selection pulses SBL1 through SBL8 being activated so as to have a high level sequentially. Thereby, when the block selection pulses SBL1 through SBL8 are activated into the high level, analog switches AS corresponding to the selected block BL1 through BL8 are turned on, and, thereby, the display signals are held sequentially by the data signal lines provided for the relevant block.

Further, according to a gate control signal GC supplied to a shift register 11 and a multiplexer 13 from the driver IC 29, TFTs are turned on for each horizontal line, the data is written in each pixel cell of the display area 100, and thus, an image is displayed there.

As shown in FIG. 6, (*b*) and (*c*), in order to avoid so-called flickering on the display area 100, in the TAB output signals supplied to each block, the polarity of the display signal is opposite between the odd-numbered dot (pixel cell) and even-numbered dot, and, also, the TAB output is controlled so that the voltage applied thereby is controlled by an alternate-current manner, in order to avoid permanent transformation of the pixel cells of the liquid crystal display panel.

Figure 7:
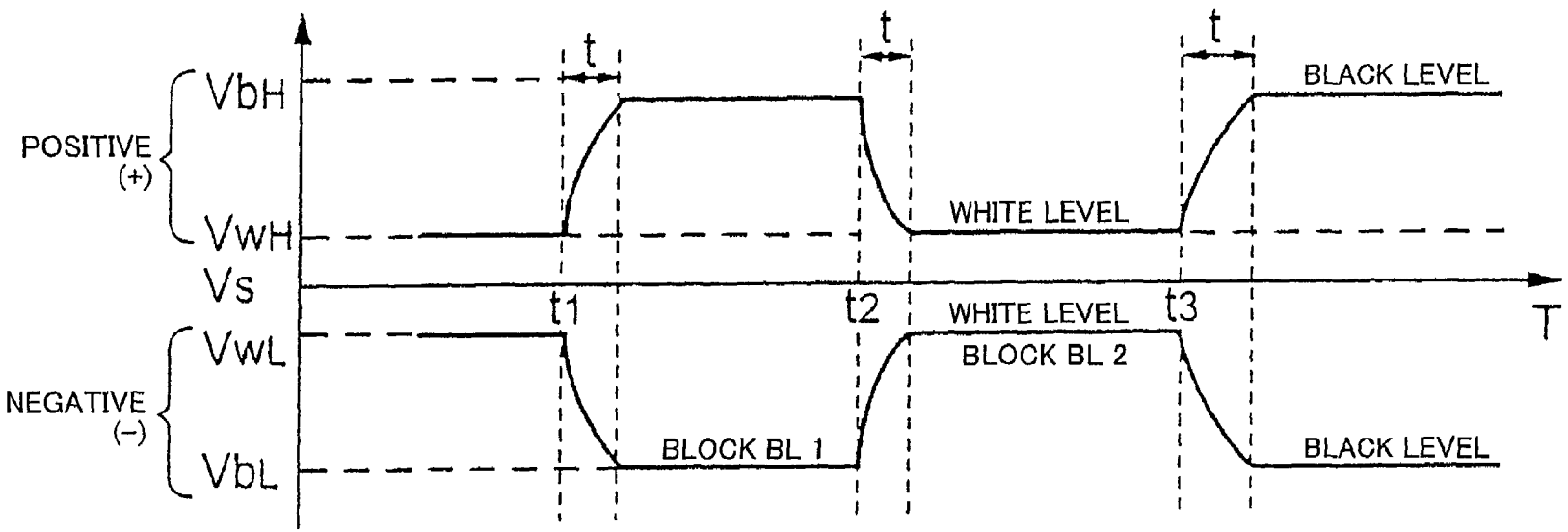
FIG. 7 shows waveforms of TAB output signals shown in FIG. 6.

For example, as shown in FIG. 7, in writing black in the pixel cells of the block BL1 and writing white in the pixel cells of the block BL2, for the odd-numbered pixel cells, the display signals are made into a voltage VbH of a black level at a time t1, and, then, the display signals are made into a voltage VwH of a white level at a time t2. In this case, in order to change the voltage of the display signals from the voltage VwH of the white level to the voltage VbH of the black level, a time 't' is required, Similarly, in order to change the voltage of the display signals from the voltage VbH of the black level to the voltage VwH of the white level at the time t2, the time 't' is required. Further, also at a time t3, the time 't' is required in order to change the voltage of the display signals from the voltage VwH to the voltage VbH.

Similarly, for the even-numbered pixel cells (negative part), the display signals are made into the voltage VbL of the black level at the time t1, and, then, the display signals are made into the voltage VwH of the black level at the time t2. In this case, in order to change the voltage of the display signals from the voltage VbL of the black level to the voltage VwL of the white level, the time 't' is required, Similarly, in order to change the voltage of the display signals from the voltage VwL of the white level to the voltage VbL of the black level at the time t2, the time 't' is required.

According to the liquid crystal display in the first embodiment of the present invention, since each of the display signals D1 through D300 is driven by a plurality of output buffers together, the data charging up time required for charging the signal lines can be effectively shortened, and thus, the above-mentioned time 't' can be positively made shorter than the above-mentioned (1 horizontal period)/(number of divided blocks). Thereby, writing of image display data for each block in the display area 100 can be made satisfactorily at a high speed, and, thus, high-quality liquid crystal display image displaying can be attained. Accordingly, even in a high-display-definition liquid crystal panel having a large-sized screen, satisfactory image displaying can be made.

A second embodiment of the present invention will now be described.

Figure 8:
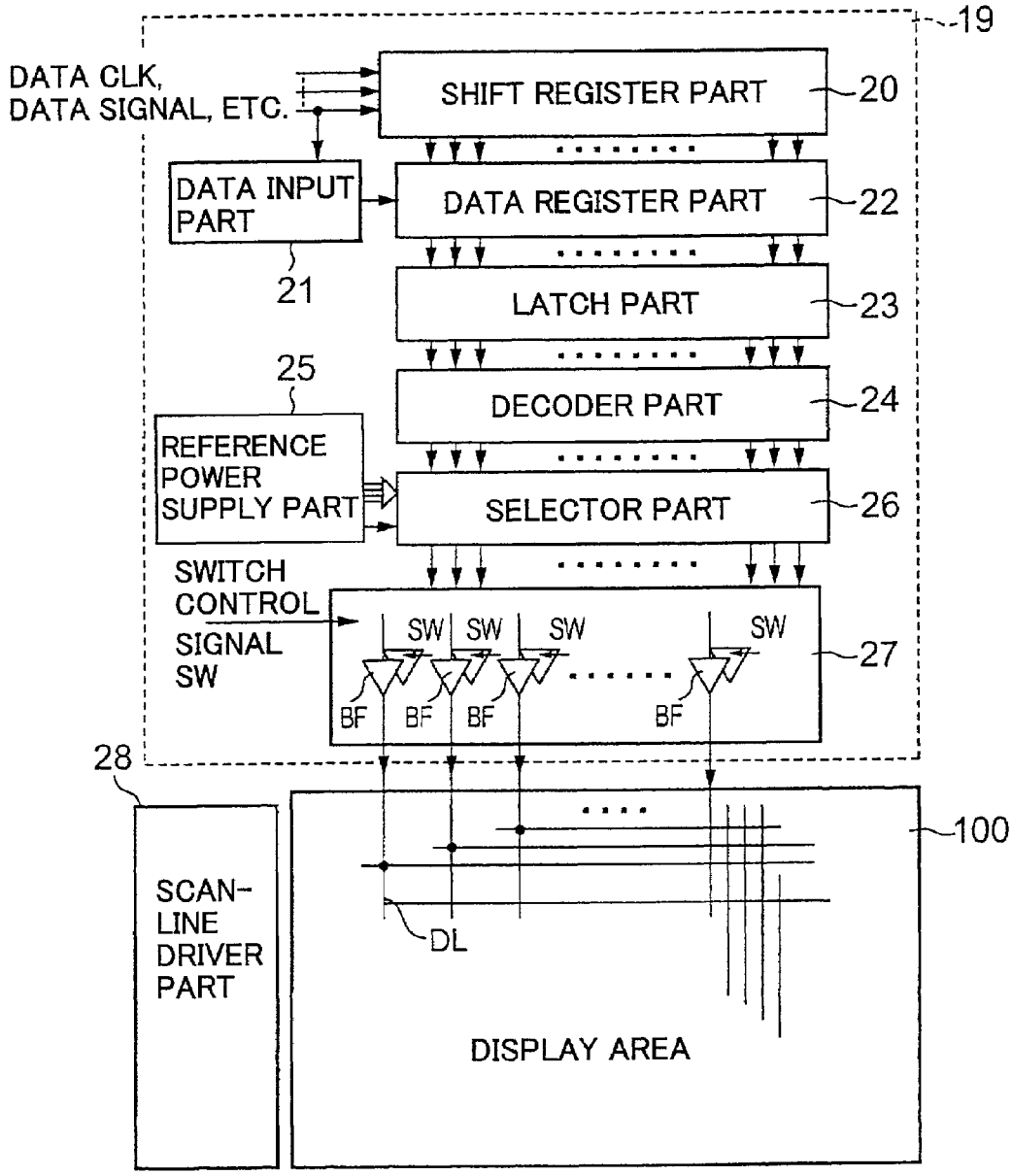
FIG. 8 shows a configuration of a liquid crystal display in a second embodiment of the present invention.

FIG. 8 shows a configuration of a liquid crystal display in the second embodiment of the present invention. As shown in FIG. 8, the liquid crystal display in the second embodiment includes a data driver part 19 including a shift register part 20, a data input part 21, a data register part 22, a latch part 23, a decoder part 24, a reference power supply production part 25 and a selector part 26 and an output part 27, a scanning line driver part 28 and a display area 100.

Data signals are input to the data input part 21 and the shift register part 20, and also, a control signal, such as a data clock signal CLK, is further supplied to the shift register part 20. Further, the data register part 22 is connected to the data input part 21 and the shift register part 20, and the latch part 23 is connected to the data register part 22. Further, the decoder part 24 is connected to the latch part 23, and the selector part 26 is connected to the decoder part 24 and the standard power supply production part 25. Furthermore, the output part 27 is connected to the selector part 26, and the display area 100 is connected to the output part 27 and the scanning line driver part 28.

In the liquid crystal display in the second embodiment, which has the above-described configuration, the output part 27 includes output buffers, in such a manner that a plurality of, for example, two of the output buffers BF are connected to each data signal line DL provided for the display area 100. Each output buffer BF is connected to the data signal line DL according to a switch control signal SW supplied to the output part 27.

Figure 9A:
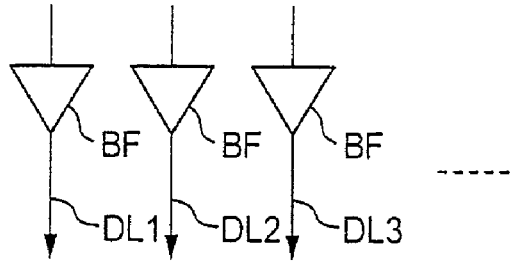
FIGS. 9A, 9B and 9C show alternative configurations of output buffers included in a data driver in the second embodiment of the present invention.
Figure 9B:
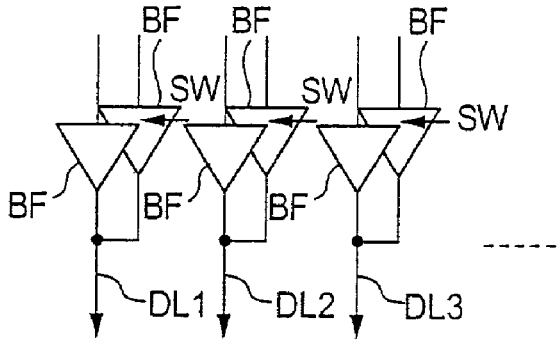
Figure 9C:
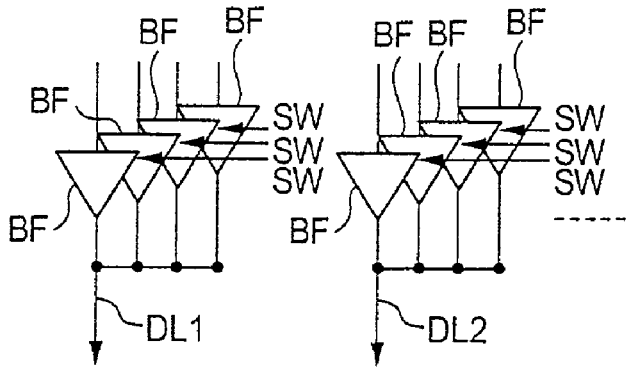

That is, according to the liquid crystal display in the second embodiment of the present invention, as shown in FIG. 9A, according to the switch control signal SW, each of the data signal lines DL1 through DL3, . . . can be driven by one output buffer BF, or, as shown in FIG. 9B, each of the data signal lines DL1 through DL3, . . . can be driven by two output buffers BF, or, as shown in FIG. 9C, each of the data signal lines DL1 through DL3, . . . can be driven by four output buffers BF. The above-mentioned switch control signal SW is a signal such as that to make the respective output buffers BF active or inactive.

Accordingly, according to the required driving capability, the number of output buffers BF which drives each data signal line DL is switched or changed. The number of the output buffers BF required varies according to the particular type (based on resolution, size, etc. of the display area 100) of display area 100.

Figure 10:
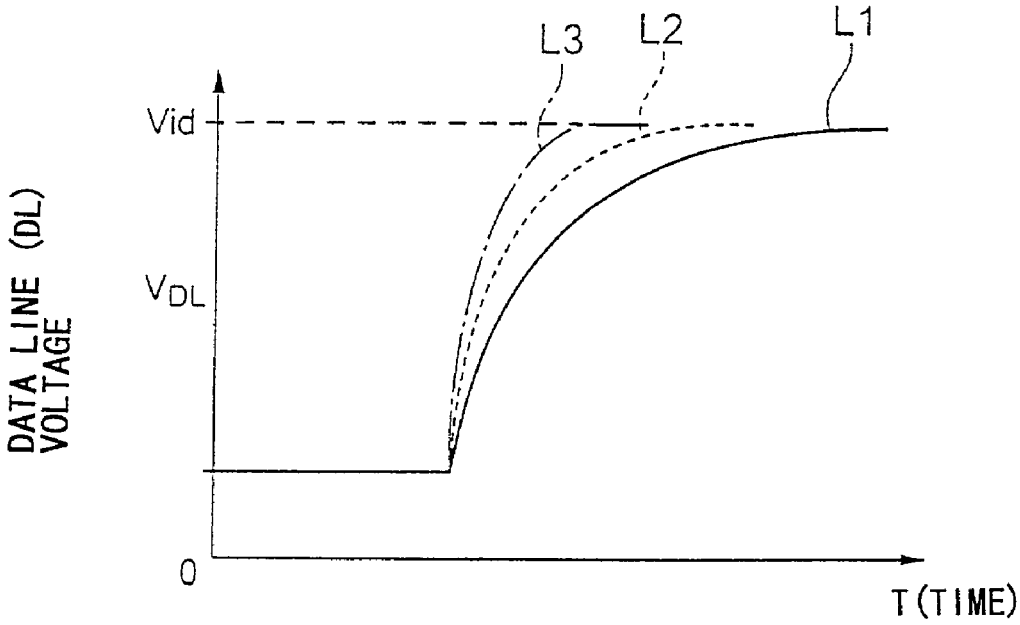
FIG. 10 illustrates an operation of the output buffers in the second embodiment of the present invention.

As shown in FIG. 10, when each data signal line DL is driven by one output buffer BF, the voltage level VDL of the data signal line DL rises relatively slowly as shown by a solid line L1. When each data signal line DL is driven by two output buffers BF together, the voltage level VDL of the data signal line DL rises relatively sharply as shown by a dashed line L2. When each data signal line DL is driven by three output buffers BF together, the voltage level VDL of the data signal line DL rises more sharply as shown a chain line L3. As shown in FIG. 10, the voltage level VDL of the data signal line DL rises exponentially so as to converge to a target voltage level Vid.

Thus, as the number of output buffers BF to drive each data signal line DL is increased, the driving capability increases, and, thereby, the time required for reaching the target voltage level Vid becomes shorter. Thus, the driving capability can be optimized according to the particular type of the display area 100 by appropriately selecting the number of output buffers BF actually used for driving each data signal line. Further, according to the liquid crystal display in the second embodiment, since each data signal line DL can also be driven by one output buffer BF as mentioned above, the driver IC including these output buffers BF can also be used as a general-purpose driver.

In addition, although, in the liquid crystal display according to the second embodiment, as shown in FIG. 8, the data driver part 19 is formed on the PCB (Printed Circuit Board) which is separate from the substrate on which the display area 100 is formed. However, it is also possible that at least one portion of the data driver part 19 is formed on the same substrate on which the display area 100 is formed.

A third embodiment of the present invention will now be described.

Figure 11:
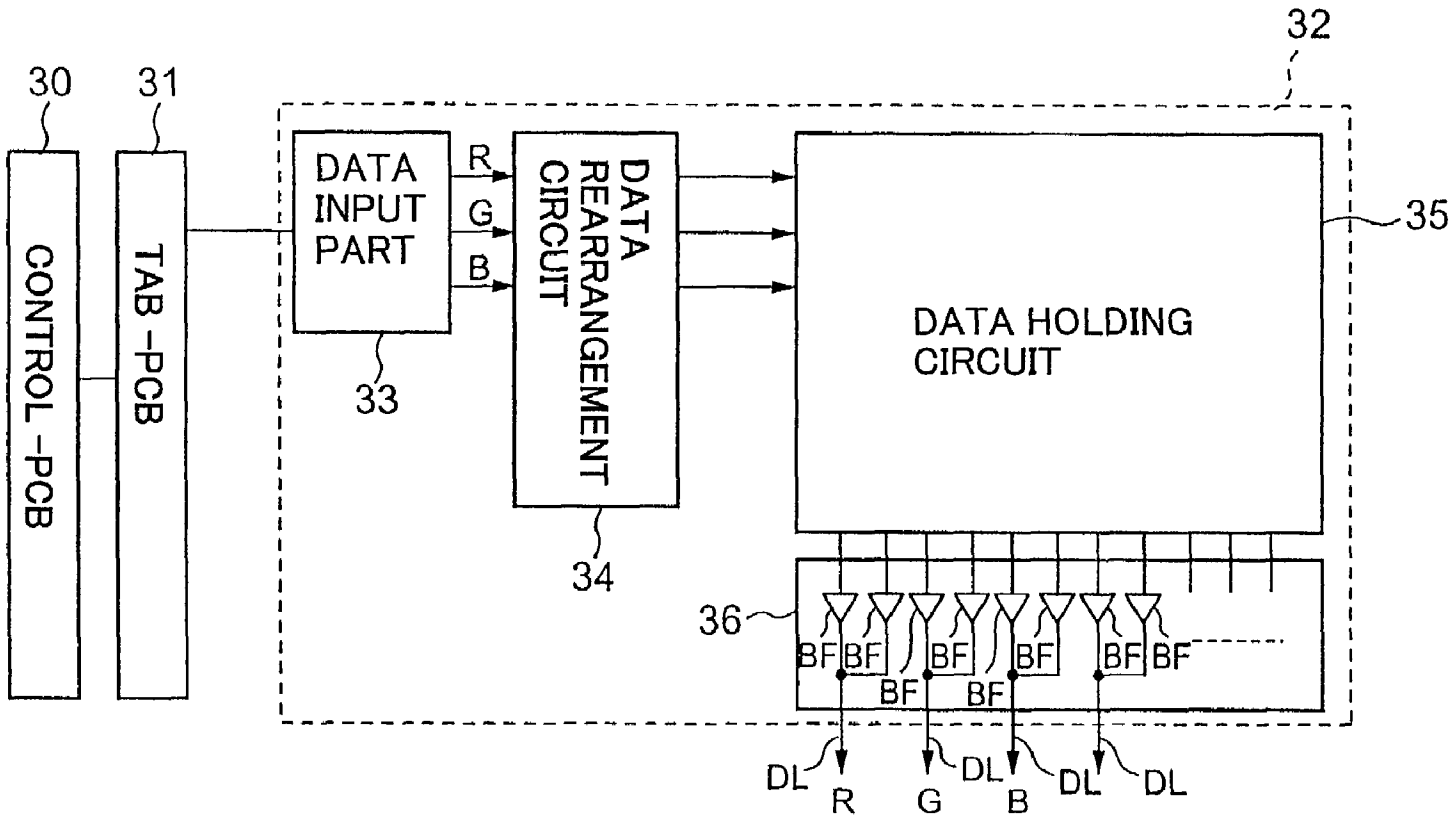
FIG. 11 shows a configuration of a driver IC in a third embodiment of the present invention.

FIG. 11 shows a configuration of a driver IC according to the third embodiment of the present invention. As shown in FIG. 11, the driver IC 32 in the third embodiment is connected to a TAB-PCB 31 and includes a data input part 33, a data rearrangement circuit 34, a data holding circuit 35, and an output part 36. In addition, as shown in FIG. 11, a control-PCB 30 is connected to the TAB-PCB 31.

The data input part 33 is connected to the TAB-PCB 31, and the data rearrangement circuit 34 is connected to the data input part 33. Further, the data holding circuit 35 is connected to the data rearrangement circuit 34, and the output part 36 is connected to the data holding circuit 35.

Furthermore, as shown in FIG. 11, the output part 36 includes a plurality of output buffers BF such a manner that two output buffers BF are connected to each data signal line DL in parallel. That is, since the driver IC 32 shown in FIG. 11 drives each data signal line DL by the plurality of output buffers BF while having a function of data rearrangement through the data rearrangement part 34, the driving capability for the data signal lines DL can be increased.

Similar to the output part 27 of the above-described second embodiment shown in FIG. 8, by providing a configuration such that the particular output buffers BF included in the output part 36 may be switched to be turned on and turned off, since each data signal line DL can be adaptively driven by the number of output buffers BF which is made to be one or to match the particular type of the liquid crystal panel, flexibility thereof can be improved, and the driver can be applied for a wider range of use.

Further, in the above-described configuration, a general-purpose driver may be used instead of the driver IC 32 by providing the data rearrangement circuit 34 shown in FIG. 11 in the control-PCB 30, and forming the output part 36 on the glass substrate on which the liquid crystal panel is also formed.

A fourth embodiment of the present invention will now be described.

Figure 12:
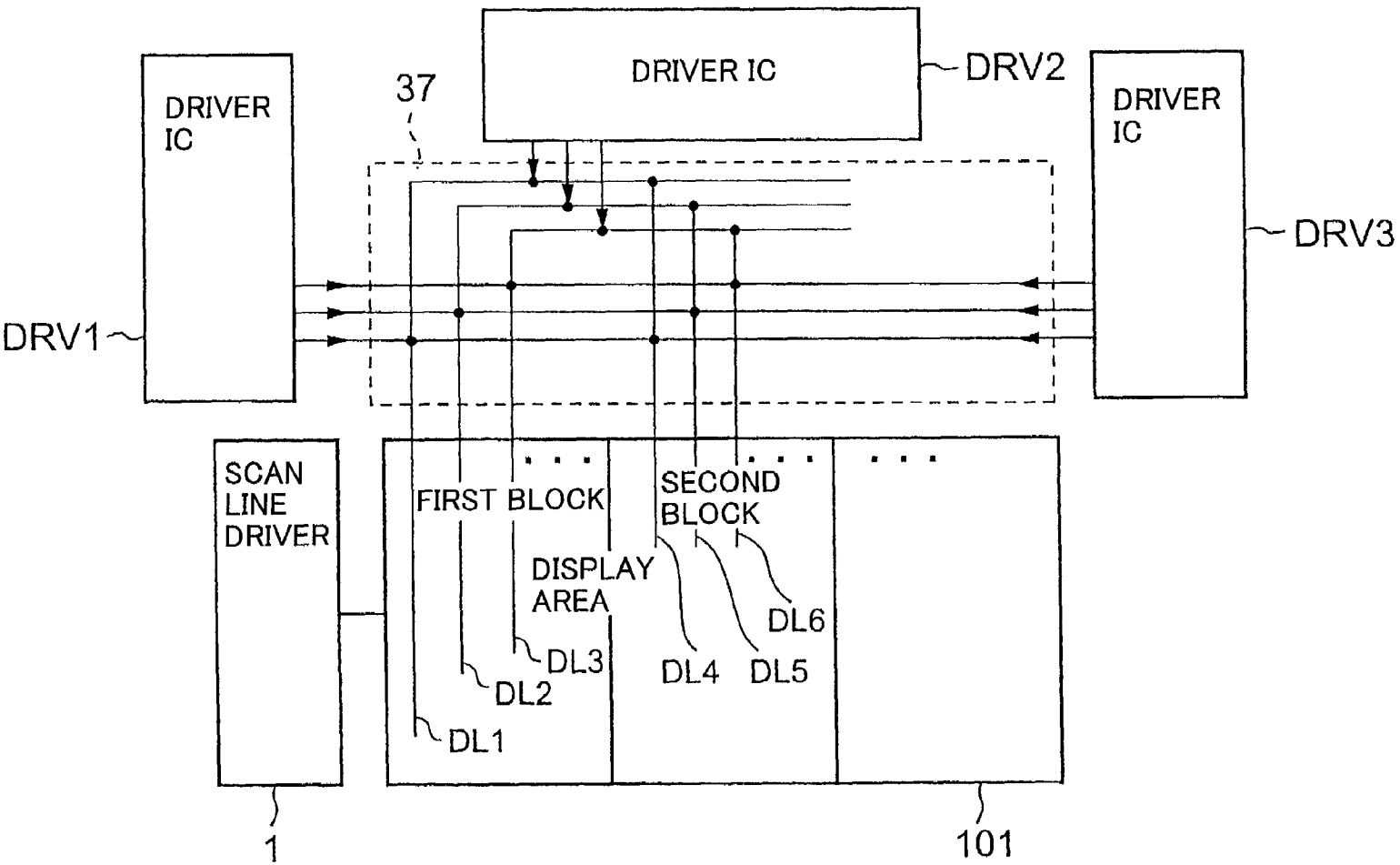
FIG. 12 shows a configuration of a liquid crystal display in a fourth embodiment of the present invention.

FIG. 12 shows a configuration of a liquid crystal display in the fourth embodiment of the present invention. As shown in FIG. 12, the liquid crystal display according to the fourth embodiment includes a display area 101, a scanning line driver 1, three driver ICs DRV1 through DRV3, and a wiring part 37. The display area 101 includes data signal lines DL1 through DL6, . . . .

In the liquid crystal display according to the fourth embodiment, the wiring part 37 is formed on one side with respect to the display area 101, and the three driver ICs DRV1 through DRV3 are connected to the wiring part 37. Further, each of the data signal lines DL1 through DL6, . . . is connected to the three general-purpose drivers in the wiring part 37.

According to the above-described configuration, since each of the data signal lines DL1 through DL6, . . . can be simultaneously driven by the three drivers (specifically, output buffers included in these drivers), the driving capability for each of the data signal lines DL1 through DL6, . . . can be effectively increased, and data charging up can satisfactorily be performed on the data signal lines thereby.

In addition, in the above-described configuration, the above-mentioned wiring part 37 is formed on the glass substrate on which the display area 101 is also formed. However, it is also possible that the wiring part 37 is formed on a driver TAB print circuit board attached to this glass substrate.

Figure 13:
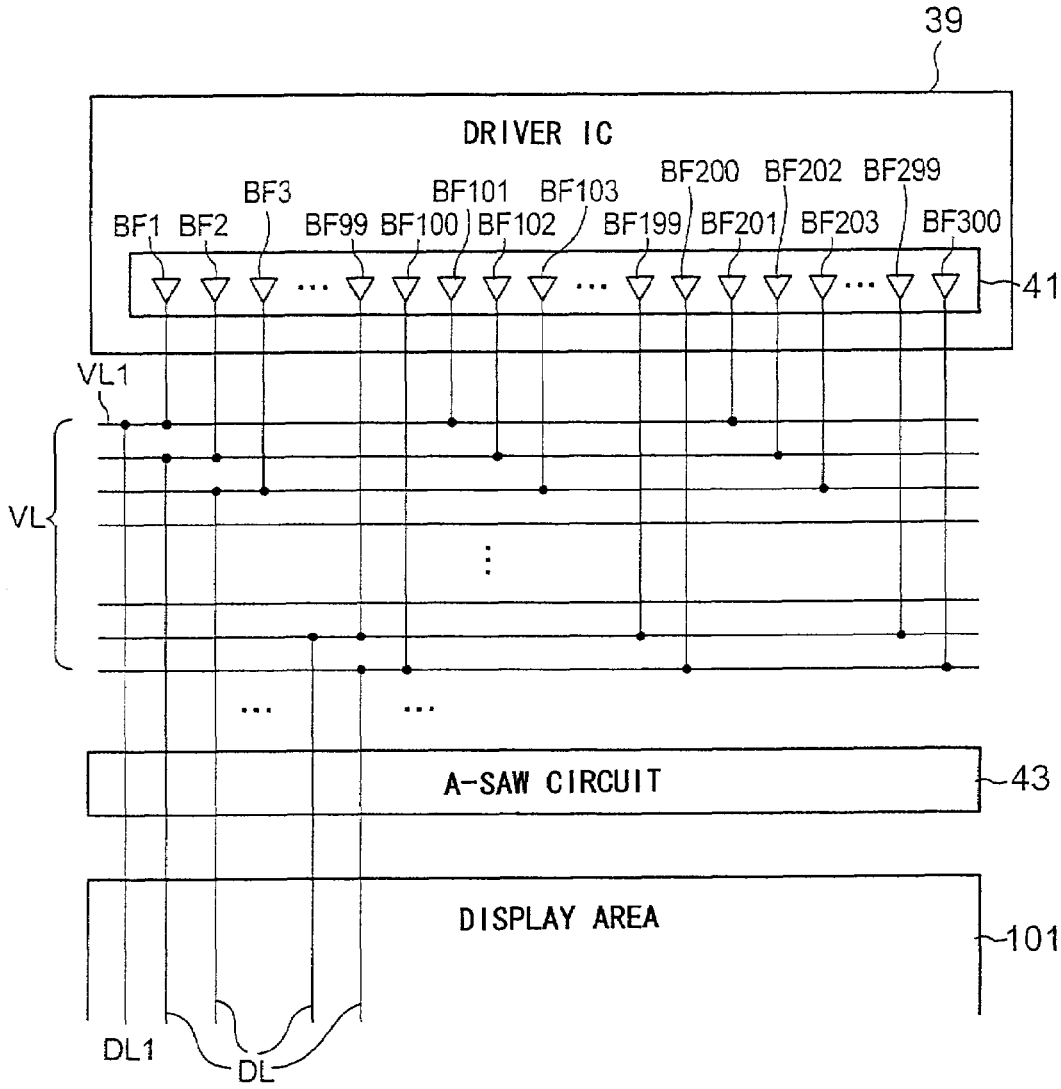
FIG. 13 shows a configuration of a liquid crystal display in a fifth embodiment of the present invention.

A fifth embodiment of the present invention will now be described. FIG. 13 shows a configuration of a liquid crystal display in the fifth embodiment of the present invention. As shown in FIG. 13, the liquid crystal display in the fifth embodiment includes a driver IC 39, video lines VL, an analog-switch (A-SW) part 43, and a display area 101, and the driver IC 39 includes an output part 41. In this case, as an example, the 100 video lines VL are provided while 300 sets of output are made by the output part 41.

In this configuration, as a plurality of output buffers BF are connected to each of the plurality of video lines VL provided in parallel, the driving capability is increased. For example, as shown in FIG. 13, in case the three output buffers are connected to each of the video lines VL, the driving capability becomes three times. Thus, the more the number of output buffers connected to each video line VL is increased, the more the driving capability can be increased accordingly.

More specifically, to the video line VL1, the output buffers BF1, BF101, and BF201 are connected, as shown in the figure, and the data signal supplied to this video line VL1 is outputted to the data signal line DL1.

In case appropriate switching of the signals of the data signal lines DL between the video lines VL and the display area 101 is made by the analog switch part 43 shown in FIG. 13 as described above with reference to FIG. 6, divisional driving (sequentially for the respective blocks) of the display area 101 may also be carried out.

Further, the above-mentioned video lines VL are formed on a glass substrate on which the display area 101 is also formed, or on a TAB-PCB attached to the glass substrate.

Thus, according to the liquid crystal display in the fifth embodiment, each video line VL is driven by the plurality of output buffers, and the display signals can be supplied to the data signal lines DL1, DL through the video lines VL. Thereby, the driving capability for the data signal lines DL1, DL can be increased.

A sixth embodiment of the present invention will now be described.

Figure 14:
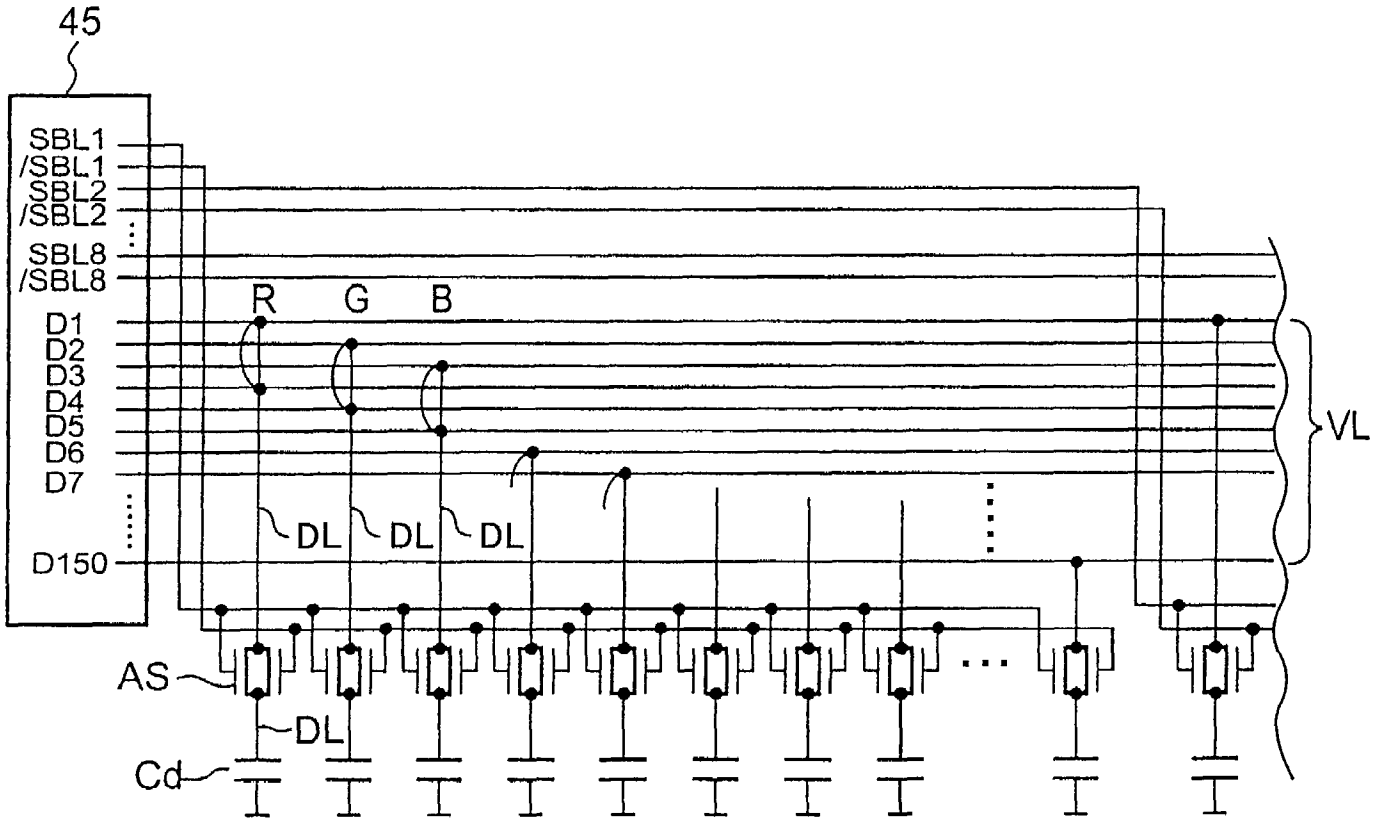
FIG. 14 shows a configuration of a liquid crystal display in a sixth embodiment of the present invention.

FIG. 14 shows a configuration of a liquid crystal display in the sixth embodiment of the present invention. As shown in FIG. 14, the liquid crystal display in the sixth embodiment includes a driver IC 45 having 2 input ports through which two sets of signals for respective color components RGB are input thereto simultaneously. In this liquid crystal display, the same data is provided to the two ports. On other words, RGB data is supplied to the first port while the same RGB data is supplied to the second port simultaneously.

As shown in FIG. 14, on a glass substrate or a driver TAB-PCB, each data signal line DL is connected to a plurality of (two, in the example of the figure) video lines VL which transmit the same color signal, and the video lines VL and the data signal lines DL of the polysilicon LCD are driven. In this embodiment, a general-purpose driver of a two-input-port type is employed, since combination of the input data signals should be considered.

Then, the display signals (for example, display signals D1 and D4) of the same color are supplied to the common data signal line DL for each color component of RGB, for example. As the same data is inputted through the two ports, the driving capability for each data signal line DL via an analog switch AS can be improved. In this configuration, the driver IC 45 can supply the respective display signal for each signal line DL.

Further, since each data signal line DL is connected with the relevant video lines VL at the plurality of points as shown in FIG. 14, different from the liquid crystal display shown in FIG. 13, the liquid crystal display according to the sixth embodiment can also have a effectively redundant configuration. In addition, the similar concept can be realized not only by using such a two-input-port driver but also by using a multi-input-port driver.

Thus, according to the first through sixth embodiments of the present invention, since one video line VL or data signal line DL is driven by a plurality of output buffers, the driving capability can be effectively increased, and the data charging up time can thus be effectively shortened.

Namely, according to the related art, the data charging up time (for example, the time 't' shown in FIG. 7) may exceed (one horizontal period/(the number of divided blocks). However, according to the present invention, it is possible to shorten the above-mentioned data charging up time to be positively shorter than (one horizontal period/(the number of divided blocks).

Accordingly, a problematic situation in that the driving capability is insufficient, and, thereby, the data level on the data signal line does not reach the expected value can be positively avoided, and, thus, a satisfactory liquid crystal image displaying can be obtained. In addition, since it is possible to employ a general-purpose driver there, a liquid crystal image displaying having a satisfactory quality can be obtained by a liquid crystal display with a large-sized screen and a high display definition while the cost reduction of the display can be attained.

A seventh embodiment of the present invention will now be described.

In a case of a panel together with a peripheral circuit thereof provided integrally, the peripheral circuit which includes analog switches may be formed at an input part on a side of data signal lines, and, then, such a dividing control of the peripheral circuit may be performed that the data signal lines may be driven every divided block thereof sequentially. Thereby, block sequential driving by which a display voltage is applied every block of the display area sequentially may be performed. For this purpose, a general-purpose liquid crystal display driver may be effectively employed.

In such a configuration, it is necessary to supply proper control signals to a dividing circuit provided on the side of the data signal lines, and to a shift register circuit provided on the side of the scanning lines. These control signals are needed to have not a low voltage which is standard for general integrated circuits but a high voltage as mentioned above. Accordingly, in the liquid crystal display in the seventh embodiment of the present invention, in order to generate such control signals, a level shift circuit for increasing the voltage of the control signals is used, and this level shift circuit is built in the data driver IC.

As a general digital data driver has an input signal level of a logic level on the order of 3 volts, for example, and, also an output signal level of a high-voltage level equal to or higher than 10 volts. Accordingly, even when the above-described level shift circuit is built therein, there occurs no problem concerning voltage withstand performance of the digital data driver.

Further, the above-mentioned level shift circuit may be any type as long as the circuit has an input transistor operable by such a low-voltage power supply and has an output transistor operable by such a high-voltage power supply.

Figure 15:
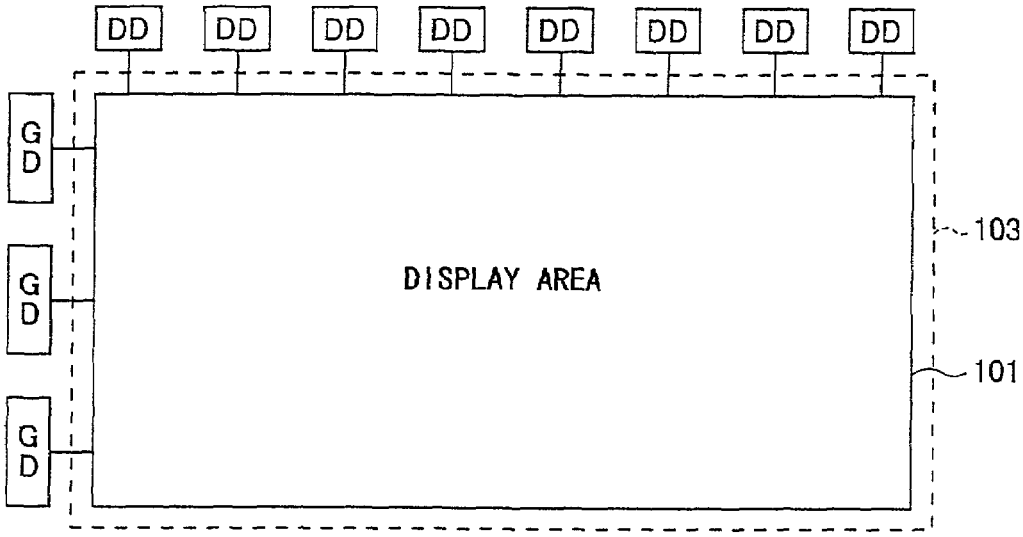
FIG. 15 shows a configuration of a liquid crystal display including a liquid crystal panel employing amorphous silicone in the related art.

According to a liquid crystal panel 103 employing amorphous silicon in the related art, as shown in FIG. 15, data driver ICs (DD) formed on a side of data signal lines which drive a display area 101 simply include only driver parts. That is, in the liquid crystal display in the related art, the driving circuits are arranged in parallel and analog voltages of 64 gray scales or 256 gray scales are outputted from these driving circuits. In addition, as shown in FIG. 15, the scanning line drivers ICs (GD) which drive scanning lines are provided in parallel on the side of the scanning lines.

Figure 16:
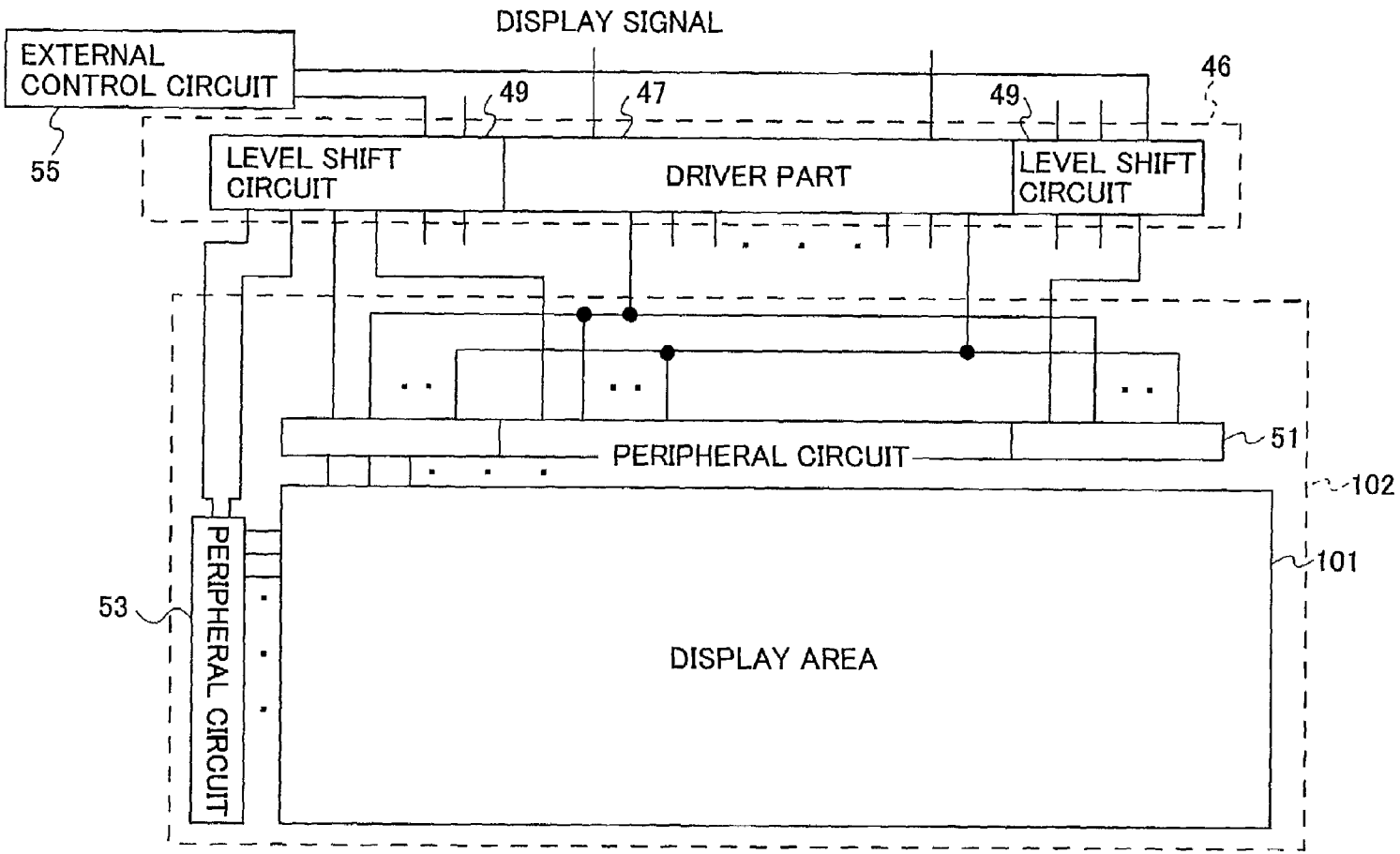
FIG. 16 shows a configuration of a liquid crystal display in a seventh embodiment of the present invention.

On the other hand, the liquid crystal display according to the seventh embodiment of the present invention, as shown in FIG. 16, includes a liquid crystal panel 102 having a peripheral circuit provided therewith integrally which includes a data-side peripheral circuit 51 and a gate-side peripheral circuit 53 as well as a display area 101 including pixel cells disposed in a matrix manner, and a data driver IC 46 having a driver part 47 and also a level shift circuit 49 built therein and driving the liquid crystal panel 102.

The control signals needed for the operation of these peripheral circuits for the display area 101 include a block dividing signal for the data signal lines and a gate clock signal, a shift-in input signal and so forth for the scanning lines. These control signals are generated by an external control circuit 55 provided outside of the liquid crystal panel 102.

The control signals generated by the external control circuit 55 have the low-voltage logic level, and, therefore, cannot directly control the peripheral circuits of the display area 101. In order to make level conversion of these control signals into signals having the high voltage which can directly control the data-side peripheral circuit 51 and the gate-side peripheral circuit 53 as mentioned above, the level shift circuit 49 therefor is built in the data driver IC 46.

Figure 17:
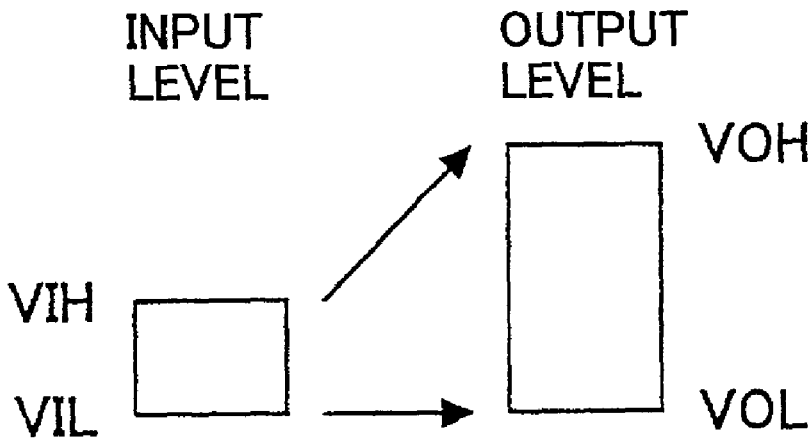
FIG. 17 illustrates operation of a level shift circuit shown in FIG. 16.

The power supply voltage of a general-purpose data driver is more than 10V. Accordingly, by determining the power supply voltage of the level shift circuit 49 to be the same as the above-mentioned power supply voltage of the general-purpose data driver, it is possible to convert the levels VIH and VIL of the input low voltage into the high levels VOH and VOL of the output voltage which can directly drive the peripheral circuits 51 and 53, and, thus, it is possible to generate the high-voltage control signals, as shown in FIG. 17, whereby the peripheral circuits 51 and 53 of the display area 101 can be directly driven as mentioned above, by a simple configuration.

Thus, according to the liquid crystal display in the seventh embodiment, the circuit scale and manufacture cost of the entire liquid crystal display can be effectively reduced as compared with the related art which performs the above-described level conversion of the control signals by the external control circuit 55.

An eighth embodiment of the present invention will now be described.

Generally, in a liquid crystal display including the above-mentioned liquid crystal panel having the peripheral circuits provided therewith integrally, analog switches are included in the driving input part on the side of data signal lines as the peripheral circuit. Then, the circuit for these data signal lines is divided into several blocks, and is driven for the respective blocks sequentially. In order to realize such a manner of driving sequentially for respective blocks, signals for properly controlling these analog switches are needed.

Figure 18:
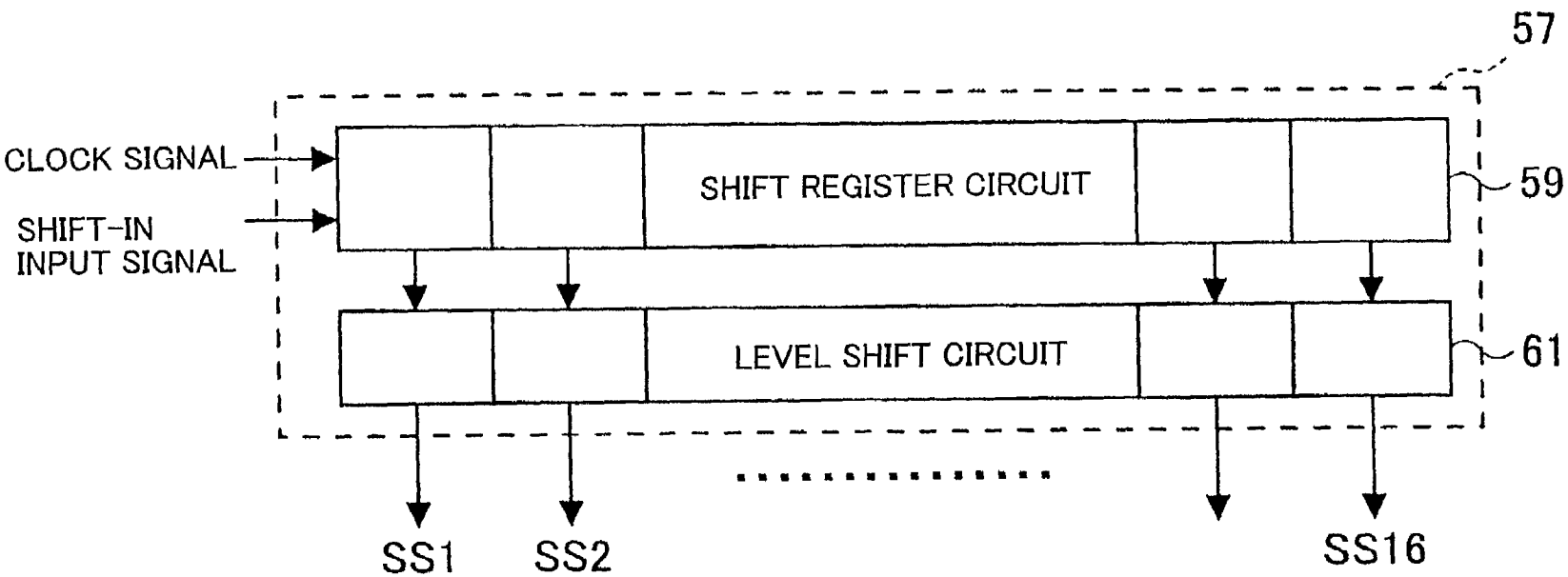
FIG. 18 shows a configuration of a data driver IC in an eighth embodiment of the present invention.

The number of these control signals needed depends on the number of thus-divided blocks, and may be several tens, for example. Therefore, in order to generate such a large number of control signals, a shift register circuit is built in the data driver IC. That is, as shown in FIG. 18, a data driver IC 57 includes a shift register part 59 to which a clock signal CLK and a shift-in input signal SI are supplied, and a level shift part 61 which is connected to the shift register part 59 outputs selection pulses SS1 through SS16.

According to the data driver IC 57 which has such a configuration, since the number of input terminals can be thus reduced effectively, the yield in mounting thereof can be effectively increased.

Further, although the shift register part 59 operates by signals which have a logic level (low level), such as the shift-in input signal SI, the signal output from the shift register part 59 is converted into signals in a high-voltage range through the level shift part 61, and, thus, the selection pulses SS1 through SS16 in this voltage range are generated.

Figure 19:
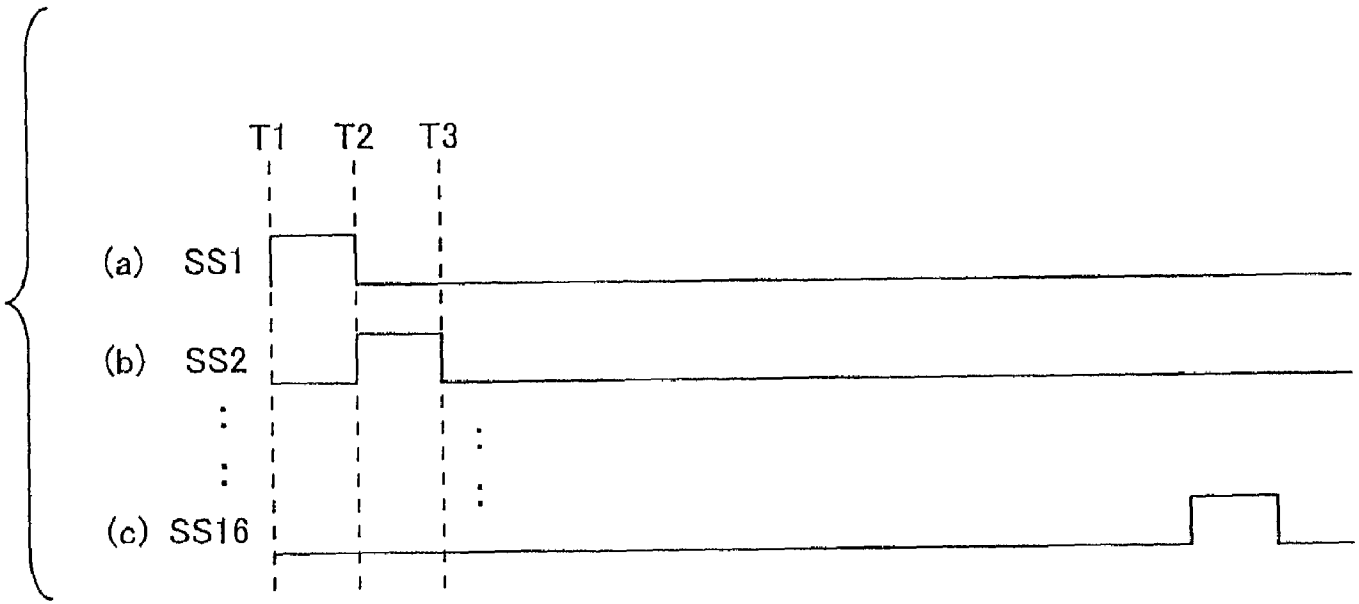
FIG. 19 shows timing charts illustrating operation of the data driver IC shown in FIG. 18.

As shown in FIGS. 19, (*a*) through (*c*), the selection pulses SS1 through SS16, which are activated sequentially every block at predetermined intervals, are supplied to the analog switches, such that the selection pulse SS1 is activated into a high level between the time T1 and the time T2, the selection pulse SS2 is activated into the high level between the time T2 and the time T3, . . . . Thereby, the analog switches are driven every block sequentially, and the above-mentioned block sequential driving operation can be realized.

Figure 20:
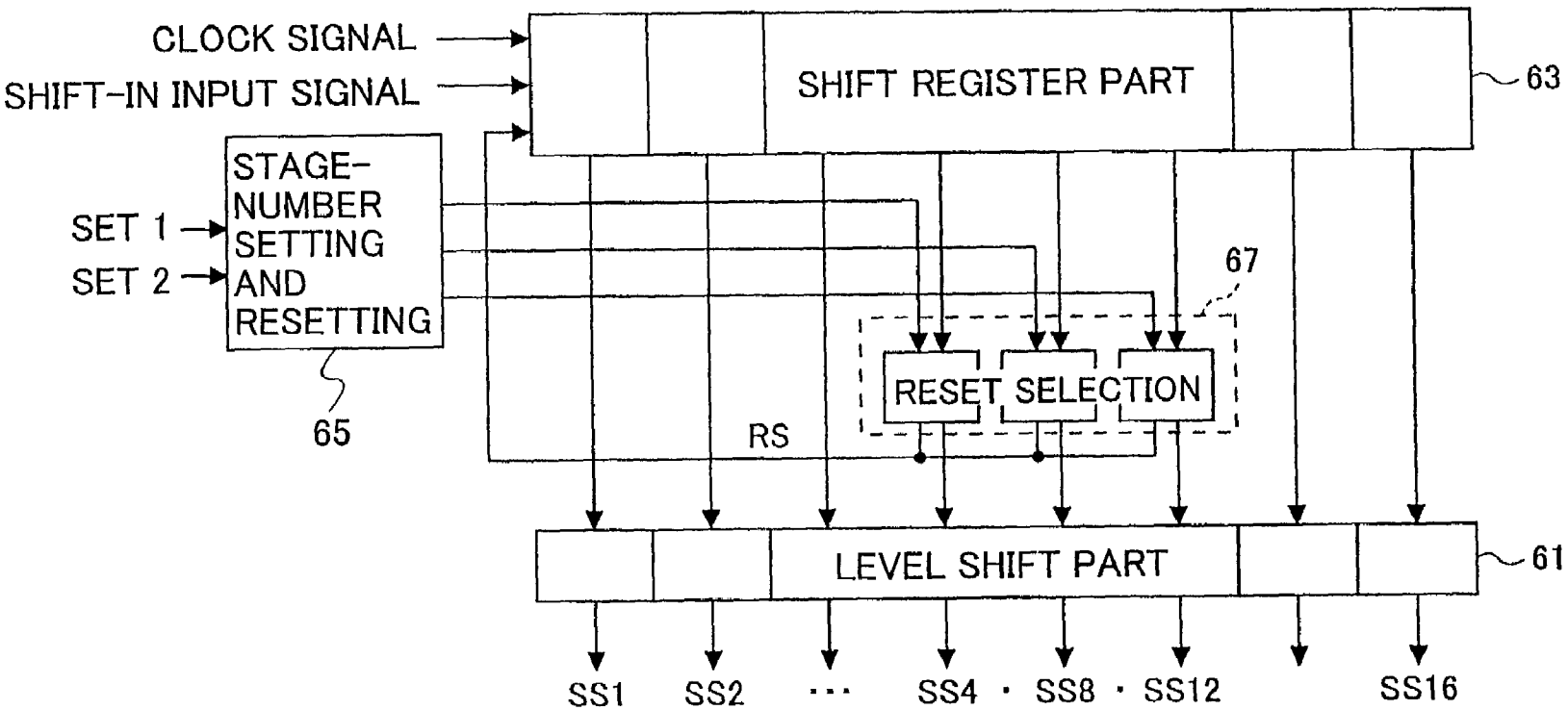
FIG. 20 shows another example of the configuration of the liquid crystal display in the eight embodiment of the present invention.

FIG. 20 shows another example of the configuration of the liquid crystal display in the eighth embodiment of the present invention. As shown in FIG. 20, the liquid crystal display in the eighth embodiment may further include a stage-number setting and resetting circuit 65, and a reset selection circuit 67 connected to the stage-number setting and resetting circuit 65.

In the liquid crystal display which has such a configuration, the number of divided blocks of the liquid crystal panel can be selected. That is, as a 2-bit signal of setting 0 and setting 1 is input to the stage-number setting and resetting circuit 65, for example, it is possible to select any one of predetermined four numbers of divided blocks by a combination of the logic levels of this signal.

Then, the reset selection circuit 67 supplies a reset signal RS to the shift register part 63 according to a signal supplied from the stage-number setting and resetting circuit 65. Thereby, the number of stages of the shift registrars to be actually used is determined.

Specifically, the reset selection circuit 67 performs logical AND between pulses output from the shift register 63 on stages of predetermined numbers (for example, 8-th stage, 10-th stage and 12-th stage) and signals (for selection with 00, 01, 10, 11 or the like) provided by the stage-number setting and resetting circuit 65. Then, the signals RS obtained thereby are returned to the shift register 6, and, thereby, the shift register is reset. As a result, shift operation is performed in the shift register 63 up to the thus-selected stage, and then, the shift register 63 returns to the initial stage. Thus, the number of actually active stages of the shift register can be selected.

Thus, according to the liquid crystal display including the circuit shown in FIG. 20, it becomes possible to easily set the optimal number of the divided blocks for the resolution of the display area of the liquid crystal panel, and the image displaying according to the resolution and size of the liquid crystal panel can be realized easily.

A ninth embodiment of the present invention will now be descried.

In each of the level shift parts in the seventh and eighth embodiments described above, a level shift circuit 69 shown in FIG. 21 may also be used.

Figure 21:
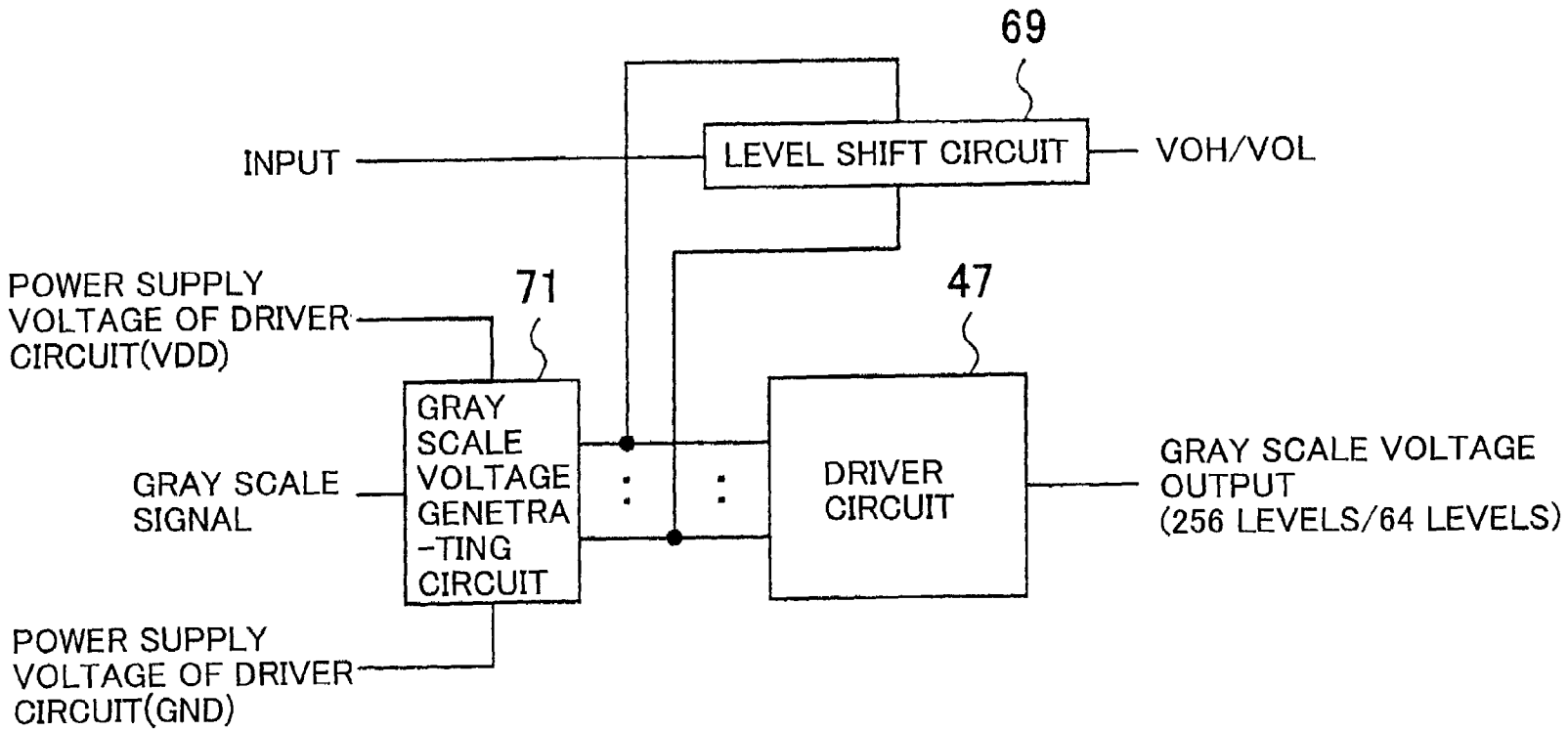
FIG. 21 shows a configuration of a level shift circuit in a ninth embodiment of the present invention.

That is, as shown in FIG. 21, the maximum voltage and the minimum voltage of a gray scale voltage output range output from a gray scale voltage generating part 71 are used, as they are, as power supply voltages for transistors included in the level shift circuit 69, and, output voltage levels VOH and VOL of the level shift circuit 69 are directly used to define a gray scale voltage range of the driver part 47.

Thus, according to the level shift circuit 69 in the ninth embodiment of the present invention, since the necessity of preparing power supply separately can be eliminated by utilizing the voltages generated by the gray scale voltage generation part 71 as power supply voltages. Thereby, the circuit scale of the entire liquid crystal display can be effectively reduced.

A tenth embodiment of the present invention will now be described.

Figure 22:
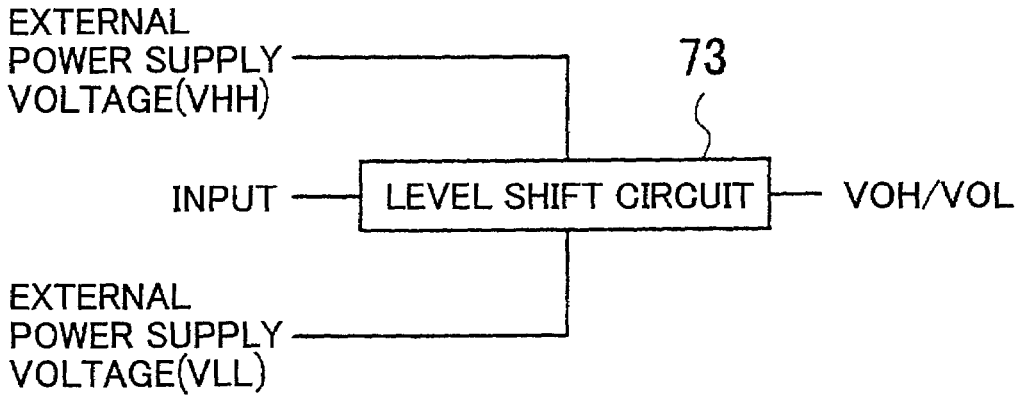
FIG. 22 shows a configuration of a level shift circuit in a tenth embodiment of the present invention.

In the level shift part according to the above-described seventh embodiment or eight embodiment, a level shift circuit 73 shown in FIG. 22 may also be used.

That is, as shown in FIG. 22, input terminals for inputting power supply voltages for the level shifting operation are provided to the level shift circuit 73, and external power supply voltages VHH and VLL are supplied to these input terminals from the outside of the liquid crystal display. Thereby, output levels VOH and VOL of the level shift circuit 69 are made to be equal to the above-mentioned external power supply voltages VHH and VLL.

Accordingly, according to the level shift circuit 73 in the tenth embodiment of the present invention, the power consumption of the liquid crystal display can be reduced by supplying low voltages as the above-mentioned external power supply voltages VHH and VLL from the outside of the liquid crystal display within a range such that the peripheral circuits of the liquid crystal panel can be operated thereby.

According to the present invention, as described above, since the driving capability of the data signal lines can be effectively increased, a satisfactory display image can be obtained.

By appropriately changing the number of driving devices (output buffers) used for driving the data signal lines according to the particular type of the display area, the driving capability of the data signal lines can be optimized easily, and the liquid crystal display can be made to be properly applicable for a wider range of use.

Further, since the control signals which have a level suitable for the operation of peripheral circuits are generated with simple configuration according to the liquid crystal display according to the present invention, a circuit scale and manufacture cost thereof can be effectively reduced.

Further, in the panel in which the display area is divided into a plurality of blocks, which are then driven sequentially, by providing a configuration for generating a control signal for selecting blocks and a configuration for selecting the number of divided blocks in the driver part, image displaying suitable for the resolution and size of the display area can be easily attained.

In addition, as a level converting part for converting a given signal level into a higher level such as to enable directly driving the peripheral circuit of the display area utilizes the power supply voltages of the driver part, there is no need to provide a power supply special for the level converting part itself, and, thus, the circuit scale can be effectively reduced.

Further, when the level converting part generates the control signal according to the power supply voltage supplied from the outside of the liquid crystal display, it is easy to adjust the level of the control signal by changing these power supply voltage supplied from the outside. Accordingly, it is easy to optimize the level of the control signal and thus, to enable saving power consumption effectively.

Further, the present invention is not limited to the above-described embodiments, and variations and modifications may be made without departing from the scope of the present invention.

The present application is based on Japanese priority application No. 2000-398892, filed on Dec. 27, 2000, the entire contents of which are hereby incorporated by reference.

What is claimed is:

1. A liquid crystal display comprising:

a display part displaying an image in accordance with image display data supplied through data signal lines; and a driving part driving each data signal line of said data signal lines by using a plurality of driving devices together simultaneously so as to increase the driving capability, wherein said plurality of driving devices are disposed on the same side of the data signal lines, wherein the number of the driving devices used for driving each data signal line is controlled in accordance with a size of said display part, and wherein control of the number of driving devices is made with the use of a switch signal.

2. The liquid crystal display as claimed in claim 1, further comprising a wiring part provided on a substrate on which said display part is formed, said driving devices being connected to said signal data line in said wiring part.

* * * * *